US005857678A

United States Patent [19]

Coleman et al.

[11] Patent Number: 5,857,678

[45] Date of Patent: Jan. 12, 1999

[54] METHOD OF PLAYING A FORM OF BACCARAT

[75] Inventors: Richard Francis Coleman; David Atkins, both of Las Vegas, Nev.

[73] Assignee: Seven Circle Resorts, Inc., Las Vegas, Nev.

[21] Appl. No.: 991,364

[22] Filed: Dec. 16, 1997

Related U.S. Application Data

[63] Continuation-in-part of Ser. No. 796,091, Feb. 5, 1997.

[60] Provisional application No. 60/011,842 Feb. 16, 1996.

[51] Int. Cl. [6] ..... A63F 1/00

[52] U.S. Cl. ..... 273/292

[58] Field of Search ..... 273/292, 274, 273/309, 303, 304, 306

[56] References Cited

U.S. PATENT DOCUMENTS

| | | | |
|---|---|---|---|
| 5,265,882 | 11/1993 | Malek | 273/292 |
| 5,328,189 | 7/1994 | Malek | 273/292 |
| 5,362,064 | 11/1994 | Lofink et al. | 273/292 |
| 5,395,119 | 3/1995 | Jacob et al. | 273/274 |
| 5,395,120 | 3/1995 | Malek | 273/292 |
| 5,411,268 | 5/1995 | Nelson et al. | 273/292 |
| 5,476,259 | 12/1995 | Weingardt | 273/85 |
| 5,722,661 | 3/1998 | Skratulia et al. | 273/292 |

OTHER PUBLICATIONS

John Scarne, "Scarne's New Complete Guide to Gambling," 1974, pp. 459–489.

Casino Gaming Concepts, Inc., "California Baccarat Brochures," 1994, 1995.

Casino Gaming Concepts, Inc., "California Baccarat," *Card Player—the Magazine for Those Who Play to Win,* Jun. 16, 1995, pp. 56–57.

*Primary Examiner*—William E. Stoll

*Attorney, Agent, or Firm*—Dorr, Carson, Sloan & Birney, P.C.

[57] ABSTRACT

A method of playing a modified form of Baccarat played on a gaming table. The acting banker and an action player are selected from a plurality of players. The acting banker establishes a bank and each of the remaining players places a wager. The dealer deals to each player including the acting banker two cards face up. Play then commences between the action player and the acting banker and moves around the table to the next player in a predetermined order. The acting banker plays each player individually according to the standard rules of Baccarat until completion. If the acting banker wins, the player's wager is added to the bank. The acting banker is not permitted to set off the amount won. At the end of play between an individual player and the acting banker, all of the player's cards are discarded and all of the acting banker's cards are discarded except the initial face up card dealt. This initial face up card is always retained by the acting banker in all games with the remaining individual players. Play continues until the acting banker's bank is exhausted or until each player at the gaming table has played his dealt hand against the hand of the acting banker.

8 Claims, 9 Drawing Sheets

METHOD OF PLAYING A FORM OF BACCARAT

PRIOR APPLICATIONS.

This application is a continuation-in-part of U.S. patent application Ser. No. 08/796,091, pending, filed Feb. 5, 1997, which, in turn, claims the benefit of U.S. Provisional Application No. 60/011,842, filed 02/16/96 pending.

BACKGROUND OF THE INVENTION

1. Field of the Invention

The present invention pertains to a variant of live card games various known as Baccarat, Baccara, or Chemin de Fer.

2. Statement of the Problem

Baccarat is an old live card game originating in Italy. Modern variants of Baccarat are played worldwide and the more popular variants are Baccarat, Chemin de Fer, Punto Banco, Baccarat-en-Banque, Scarney Baccarat, and CALIFORNIA BACCARAT™.

In Chemin de Fer, a player banks the game, whereas in Baccarat the house banks the game. In Chemin de Fer, the house provides a dealer and collects a commission such as 5%. In Baccarat, a player can bet on the bank winning or on the player winning. If the player wins, all bets on the player are paid at 1:1. If the bank wins, all bets are paid at 19:20. These games are fully explained in Chapters 16 and 17 of "Scarne's New Complete Guide to Gambling" by John Scarne (pgs. 459–489) (1974). Many players throughout the world are fully familiar with the rules of Baccarat and Chemin de Fer, especially the card drawing rules for the player and for the bank.

The variants of Baccarat are designed to increase the excitement and participation in playing the game by the players and thereby to increase the profitability of the game to the casino. A need exists to improve on Baccarat by offering a casino variant that has greater player participation and appeal yet adheres to the traditional rules, especially the card drawing rules of Baccarat. A need exists to have a casino variant where the dealer (casino) is not the bank and where the bank is capable of moving from player to player to more closely conform to Chemin de Fer. A patentability search has been conducted on the invention described here and the results are as follows.

U.S. Pat. No. 5,411,268 provides a live card game using a standard 52-card deck. In the '268 invention, the dealer deals the cards and does not act as the banker. One of the players acts as the banker. Before the play of the game commences, the "player banker" and the "action player" are chosen randomly through a random selection device such as the roll of dice. A "banker" button is placed before the banker player (a button labeled B) and an "action button" is placed before the action player (a button labeled A). Even though a player has been selected to be the banker through this randomizing process, that player has the option to decline. Once a player agrees to be banker he is the banker for a predetermined set number of plays, and thereafter the position of banker rotates around the table to subsequent players in a predetermined manner. The location of the action player button determines which player will play first against the player banker. The action then rotates from the first player to the next player in a predetermined order of rotation. If the player banker exhaust the funds on the table before him, that round of play terminates even though the remaining players have not completed their play in that hand. The '268 invention is directed to separating the dealt cards to a player into first and second hands.

U.S. Pat. No. 5,395,119 sets forth wagering methods for Baccarat. The '119 patent provides a variation to Baccarat wherein different types of "surrender" are provided wherein a player may surrender a portion of the bet depending on the value of the first two cards of the player and the banker hands. A separate surrender region is placed on the gaming table. This variant provides additional types of wagers that may be placed during the play of the game to increase the interest on the part of the players and to increase the profitability of the game for the casino.

U.S. Pat. No. 5,262,064 pertains to a modification of Baccarat. This modification eliminates the conventional 5% commission charged by the gaming establishment. The '064 invention also allows side wagers to be added to the game. The '064 invention also provides a variation to Baccarat wherein the player's and the bank's hands operate under the same criteria as to whether a third card is or is not dealt to each respective hand. In yet another variant, the '064 patent uses a mechanical randomizing device to establish a "push" or "bar" situation for what otherwise would be a winning hand. Finally, the '064 patent permits side wagers to be added to the game. A player may make an additional wager on his hand with respect to a tie or for a natural situation.

U.S. Pat. Nos. 5,395,120; 5,328,189; and 5,265,882 allow a player to play a casino game simultaneously against a dealer and other players. Under the teachings of these inventions, a player can simultaneously play draw poker against the dealer and either twenty-one or Baccarat against other players.

U.S. Pat. No. 5,476,259 sets forth a pari-mutuel electronic and live table game wherein players compete against each other to win a common pool. They do not wager against the house. In this environment, the house retains a pre-established commission.

CALIFORNIA BACCARAT™ from Casino Gaming Systems, Inc., modifies the drawing rules for the players and the acting banker and provides certain discretionary rules. In CALIFORNIA BACCARAT™ the cards are dealt face down and all players simultaneously play against the acting banker. If the bank becomes exhausted in the payout (which occurs in a predetermined manner around the table), then it is possible that players who have won will not collect. Such players have their wagers returned.

None of the prior art approaches set forth above suggest or disclose the variant to Baccarat of the present invention.

SUMMARY OF THE INVENTION

Solution to the Problem.

The present invention solves the above need by providing a variant of Baccarat that preserves the standard card drawing rules for the players and for the bank. A player need not become familiar with changes or modifications to these standard rules as found in certain prior Baccarat variants. The standard Baccarat card drawing rules are mandatory and are not discretionary so as not to slow down the play of the game. In addition this eliminates potential arguments between players and sub-bettors as to whether to draw or stand.

The present invention requires that the bank when it wins against a player accumulate the winnings in the bank to a new accumulated value. Hence, the bank has the possibility of growing in value as the play of individual Baccarat hands around the table occurs. Set off of winnings is not permitted by the banker. In this fashion, the present invention increases player participation since through accumulation of winnings the bank grows in value so as not to become exhausted as soon. None of the above prior art approaches mandate the accumulation of the winnings to cause the bank to grow in value.

Another important feature of the present invention pertains to the maintenance of the initial face card of the acting banker in all individual plays between the acting banker and each player. Under this feature, the dealer deals two cards face up to each player and to the acting banker. In the first hand between the acting banker and the action player, the two parties play conventional Baccarat according to the player and the banker card drawing rules. Once play is completed and the banker or the player wins, the action player's cards are discarded and the second (and possibly third) face-up card of the acting banker is discarded. This leaves the initial face-up card in position for the acting banker. The acting banker then is dealt a second card face up and play resumes with the next player in sequence. Again the play occurs according to the standard rules of Baccarat. After a determination is made as to who wins or loses, the next player's cards are discarded and the second (and possibly third) face-up card of the acting banker is discarded. This process continues until each player plays against the acting banker or until the acting banker's bank is exhausted. This feature is important since in the event the bank becomes exhausted, the remaining players do not know whether or not they would have won against the acting banker. Such ignorance results in less dissatisfaction than with other variants of Baccarat.

The present invention is also used for alternate embodiments of the drawing rules for Baccarat, Baccara, Chemin de Fer.

Finally, the present invention treats the vigorish (viggerish or vig) differently from conventional Baccarat. Normally, a percentage commission of the full value of the bank is paid by the acting banker. Under the teachings of the present invention, the acting banker may only be required to place the same commission as is all other players. This provides added incentive for a player to become an acting banker.

Summary of Invention.

A method of playing a modified form of Baccarat played on a gaming table with at least one deck of 52 cards, a plurality of players seated at the gaming table, and a dealer positioned at the gaming table is disclosed. The method comprises the steps of selecting an acting banker and an action player from the plurality of players. The acting banker places a bank on the gaming table and each of the remaining players places a wager on the gaming table. The acting banker and the remaining players also place a commission. The value of the commission may be the same for the acting banker and the players. Designated areas are visibly formed on the surface of the gaming table for placement of the commissions and the wagers including the bank. The dealer commences the deal of the cards with the action player. The dealer deals to each player including the acting banker two cards face up. Play then commences between the action player and the acting banker and moves around the table in a predetermined order such as a clockwise rotation. The acting banker plays against each player individually according to the standard rules of Baccarat until completion. If the acting banker wins, the player's wager is added to the bank up to the value of the bank. The acting banker is not permitted to set off the amount won. The bank grows in value when the acting banker wins. If the player wins, an amount equal to the player's wager is taken from the bank and awarded to the player. At the end of play between an individual player and the acting banker, all of the player's cards are discarded and all of the acting banker's cards are discarded except the initial face-up card dealt (i.e., the first card dealt to the acting banker). This initial face up card is always retained by the acting banker in all hands with the remaining individual players. Play continues from player to player until the acting banker's bank is exhausted or until each player at the gaming table has played his dealt hands against the hand of the acting banker.

DETAILED DESCRIPTION OF THE INVENTION

Overview.

Figure 1:
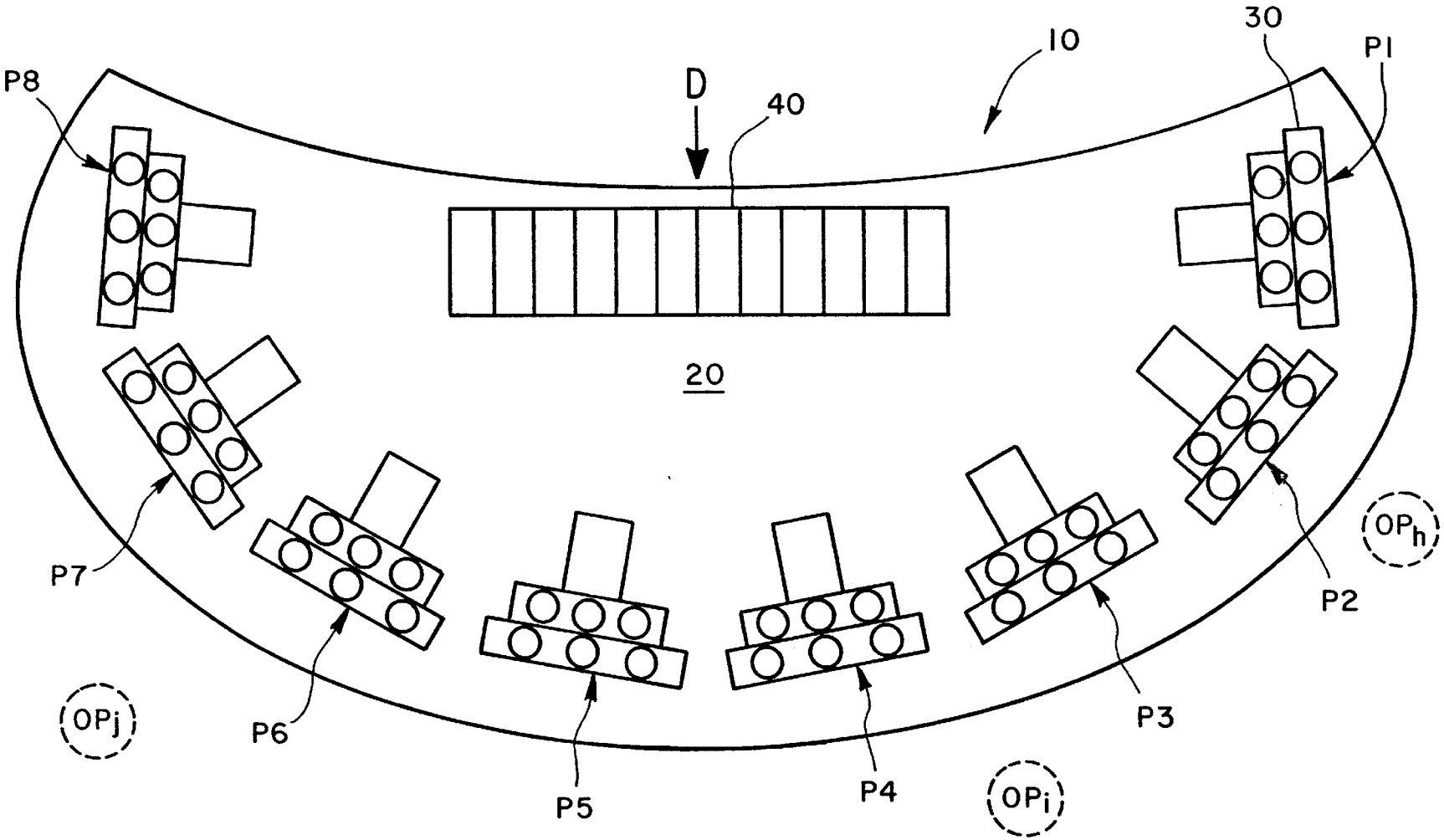
FIG. 1 is a top planar view of the gaming table of the present invention.

In FIG. 1, a gaming table 10 is shown. On the surface 20 of the gaming table 10 are located eight player positions 30. These are numbered P1–P8 to correspond to players sitting at each position 30. Other persons, generally referred to as OP, watch the live card game and may participate with side bets. Also on the surface 20 is a dealer's position D.

Figure 2:
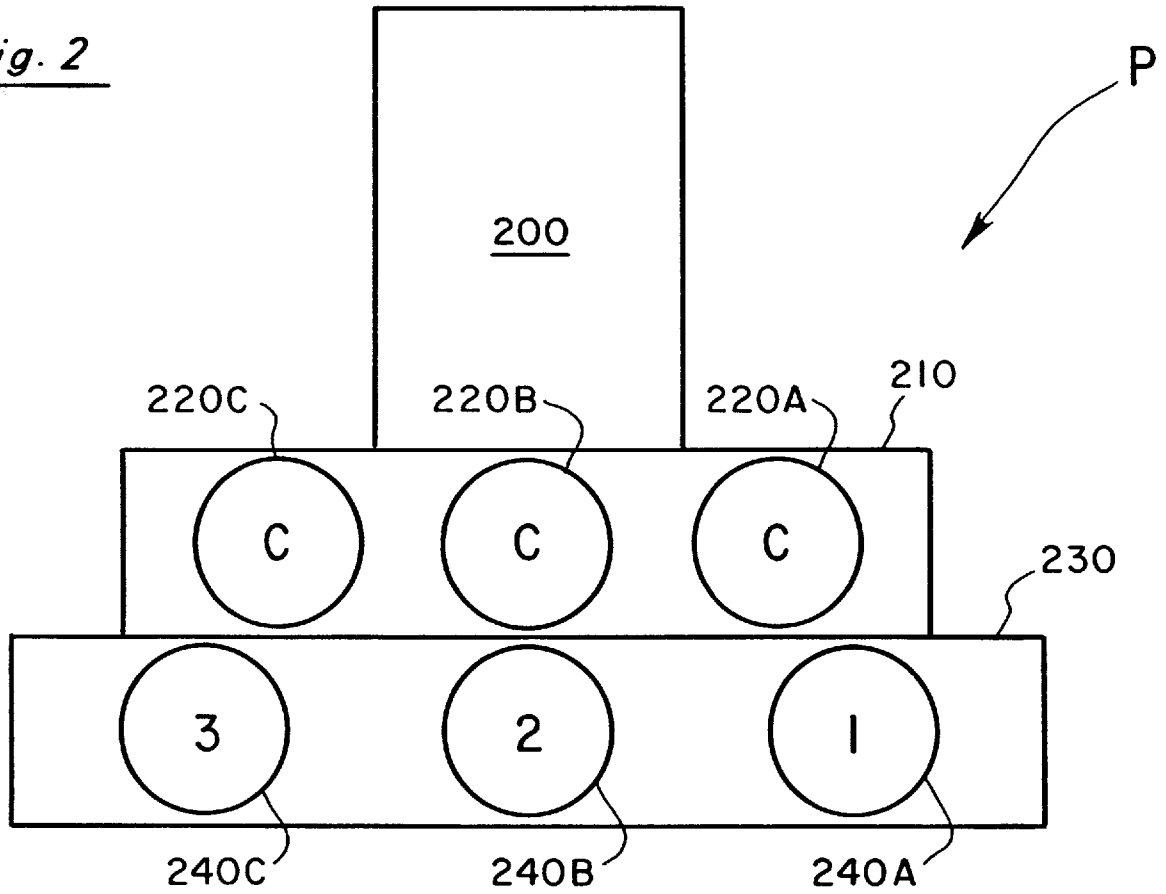
FIG. 2 illustrates in greater detail a player's position on the gaming table of FIG. 1.

Each player position P, as shown in FIG. 2, has three designated regions. Region 200 is the region in which cards are played. Region 210 has three areas 220 with a C designation in a marked circle 220. These are areas in which the commission C is placed by a player P or by a person placing a side bet. Region 230 has three areas 240 for receiving the bet placed by the player P or by a person placing a side bet. The player P at position P places his bet in area 240A designated "1". This leaves circular regions 240B and 240C that are designated "2" and "3" available for additional persons or players to place a side bet with the player.

Under the teachings of the present invention, a player at a player's position can place a bet in region 240A designated "1". The player is not permitted to also place bets in regions "2" (240B) and "3" (240C). Furthermore, any person placing side bets in regions 240B and 240C must also place a commission in the corresponding C region 220. For example, if a person is placing a side bet along with a player placing a bet in area 240A, that person would place a bet in area 240B. Both the player and the person making the side bet would place a commission in areas 220A and 220B, respectively. The person making a side bet could be another adjacent player or other person OP watching.

With reference back to FIG. 1, it can be observed that eight people (P1–P8) may occupy the eight player positions 30. Under the teachings of the present invention, seven of the "players" occupying the seating positions are players and the eighth person is the "banker." However, up to a maximum of 16 additional persons can place side bets with the seven occupied player positions and the one occupied banker position. Under the rules of the present invention, a player occupying a player position can also place side bets on any other player positions, but can never play a side bet in his own position 30. For example, player P4 may also place side bets with players P3 and P5.

It is to be expressly understood that in FIG. 1 eight seating positions 30 for eight players P1–P8 are designated. Any suitable number of seating positions could be provided under the teachings of the present invention and the present invention is not limited to eight seating positions.

In every game played according the teachings of the present invention, one player is designated to act as the "banker." The remaining players play against the banker's hand. Hence, it is possible for player P7 to be the acting banker and player P1 to be the only player. Or, the player P3 can be the acting banker and all of the other positions 30 could be occupied with players P1–P2 and P4–P8. Whether the game table 10 is fully occupied or only has one banker and one player, a dealer D is always provided at position 40.

As is conventional in casinos, the player's bets may be subject to house minimums and maximums for the table. However, under the preferred teachings of the present invention there is no maximum value for the bank.

Play of the Game.

Under the teachings of the present invention, this variant of Baccarat is played with a multiplicity of decks such as six or eight decks of 52 cards.

Placement of Bets.

With reference to FIG. 2, a player sitting at a player position 30 wishing to place a bet places a bet (e.g., $100) in area 240A and a commission (e.g., $1) in area 220A. The nature of the commission is at the discretion of the house. That player may also place side bets in the adjacent player positions 30.

For example, player P5 places a bet in area 240A of player P5's position. Player P5 sits between players P4 and P6. However, player P4 does not place a bet, and therefore player P5 is unable to place a side bet (although player P5 could also play as player P4). However, player P6 does place a bet in his area 240A. Player P5 may then place a bet in area 240B of player P6's position 30. Player P5 must also place a commission above his side bet area 220B. The present invention is not meant to limit player P5 from placing side bets with other players.

In addition, another person OP watching also has the right to place a side bet. Continuing with the above example, when player P5 has placed a bet at his own position P and a side bet at player P6's position P, another person watching the game $OP_i$ (in FIG. 1) has the right to place a side bet in player P5's position (i.e., 240B and a commission in 220B). The person watching $OP_i$ also has the right to place a side bet with player P6. Since player P5 has also placed a side bet, person $OP_i$ places a side bet in area 240C and a commission in area 220C of player P6's position 30. Player P6's position 30 is now full with a bet and two side bets.

It is to be understood that any other person watching such as persons $OP_i$, and $OP_j$ have the right to place side bets in available betting circles until all side bets are placed.

Any player may also bet with any other player including with the bank if additional betting circles 240 are available. However, the person acting as banker may not make a separate bet with any other player's bet.

Selection of the Banker.

The player P1, under the teachings of the preferred embodiment of the present invention, is asked to be banker. Player P1 has the right to decline or accept. If player P1 declines, the decision to be acting banker is passed to player P2 and so forth in a clockwise direction around the table 10. It is to be expressly understood that any predetermined selection for the banker could be achieved under the teachings of the present invention such as a counterclockwise selection starting with player P8. It is also to be expressly understood that a randomized selection of the banker could occur such as through a mechanical randomizing device, which will be discussed subsequently. In addition, as in conventional Baccarat and Chemin de Fer, in some embodiments of the present invention the banker could be selected through auctioning.

Each seated player, under the teachings of the present invention, has the option to be the acting banker only for a predetermined setting such, for example, as two consecutive hands on any betting position.

Selection of the Action Player.

The player acting as banker shakes three dice to determine the starting point for the action. The use of three dice creates a random selection between 3 and 18. For example, and with reference to Table 1, if player P3 is the acting banker and acting banker P3 shakes and rolls the three dice to a value of 11, the count starts with player P4. Of course this is only one preferred direction of rotation. The following table sets forth the count:

TABLE I

| PLAYER | P1 | P2 | P3 | P4 | P5 | P6 | P7 | P8 |
|---|---|---|---|---|---|---|---|---|
| COUNT | | | Bank | 1 | 2 | 3 | 4 | 5 |
| | 6 | 7 | Bank | 8 | 9 | 10 | 11 | |

Hence, it is determined that the action starts with player P7. Player P7 is termed the "action player." The count will not include player positions without a wager, or the position of the acting banker. It is to be expressly understood that the use of three dice to randomize the start of action in this variant of Baccarat is conventional and is not unique under the teachings of the present invention. Any suitable device could be utilized to provide such randomization such as, for example, a random number generator, a spinning wheel, etc.

Dealing the Cards.

With the point of action determined, the dealer D at position 40 commences to deal cards to each player P and to the acting banker. Each player P and the acting banker is dealt two cards face up starting from the point of action (for example, player P7 in the table set forth above) and continuing around the table 10 in clockwise fashion. The cards could be dealt wherein each player P and the acting banker receives a first card and then the second card. Or, the cards could be dealt two at a time to each player and to the acting banker.

Method of Play.

The action player, as randomly determined prior to the deal, and the acting banker will play their hands in accordance with the standard Baccarat card drawing rules set forth in Tables II and III below.

Upon completion and settlement of this hand, the first player's cards are discarded. The acting banker's second and any third card are discarded. The acting banker's first card is retained and a new second card is dealt to the acting banker for play against the next player's hand. This procedure is repeated until all hands are settled, or until the acting banker's bank is exhausted.

EXAMPLE I

This example represents a game involving player P3 as the acting banker and two players P5 and P1. The values of the cards and the completion of the game are immaterial in this example.

Figure 3:
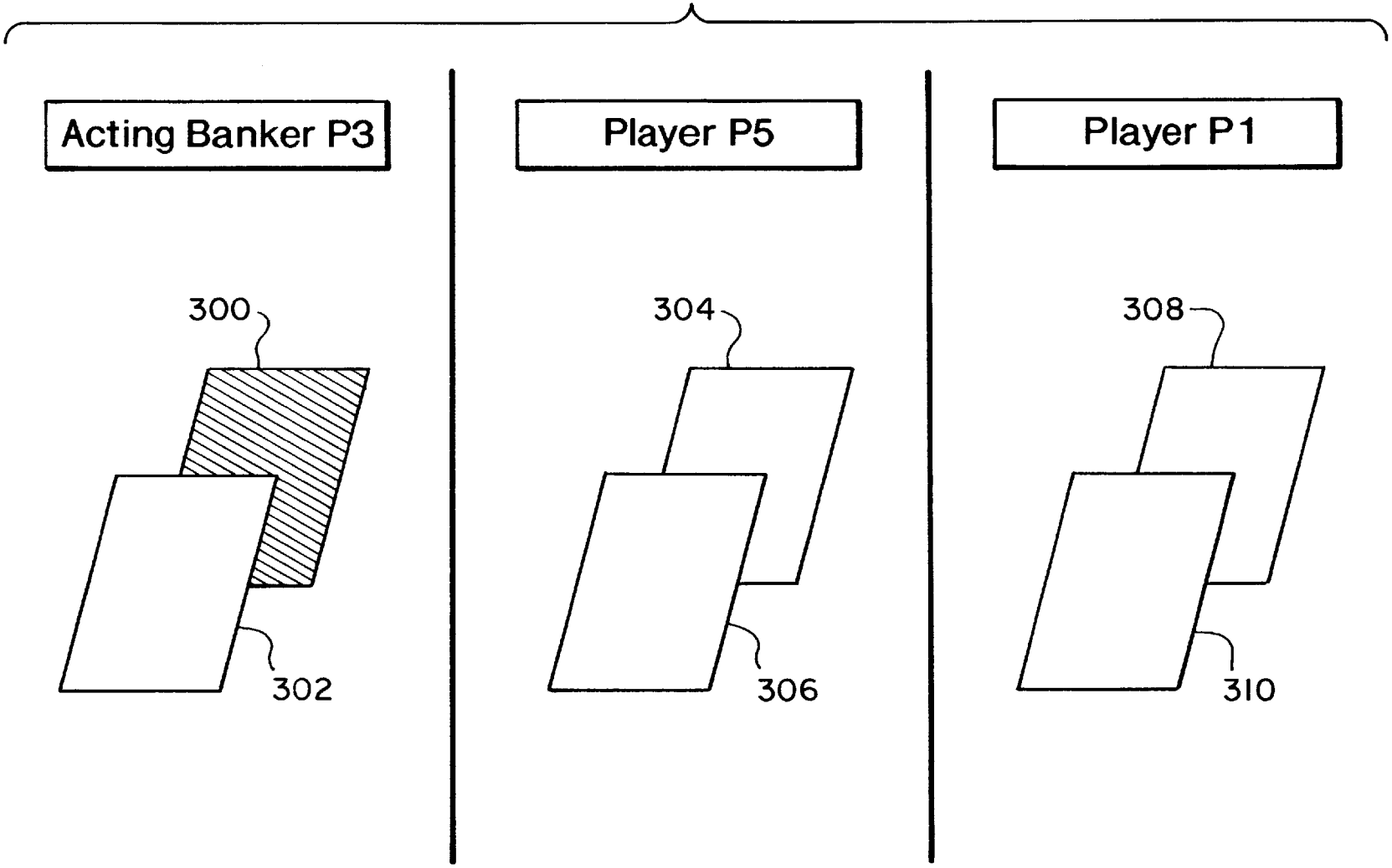
FIG. 3 illustrates the initial deal of cards to the acting banker and players in a game.

In FIG. 3 the cards 300 are shown following the initial deal, two cards face-up for each participant. Acting banker P3 has an initial face-up card 300 and a second face-up card 302. Player P5 has face-up cards 304 and 306. Player P1 has face-up cards 308 and 310.

Figure 4:
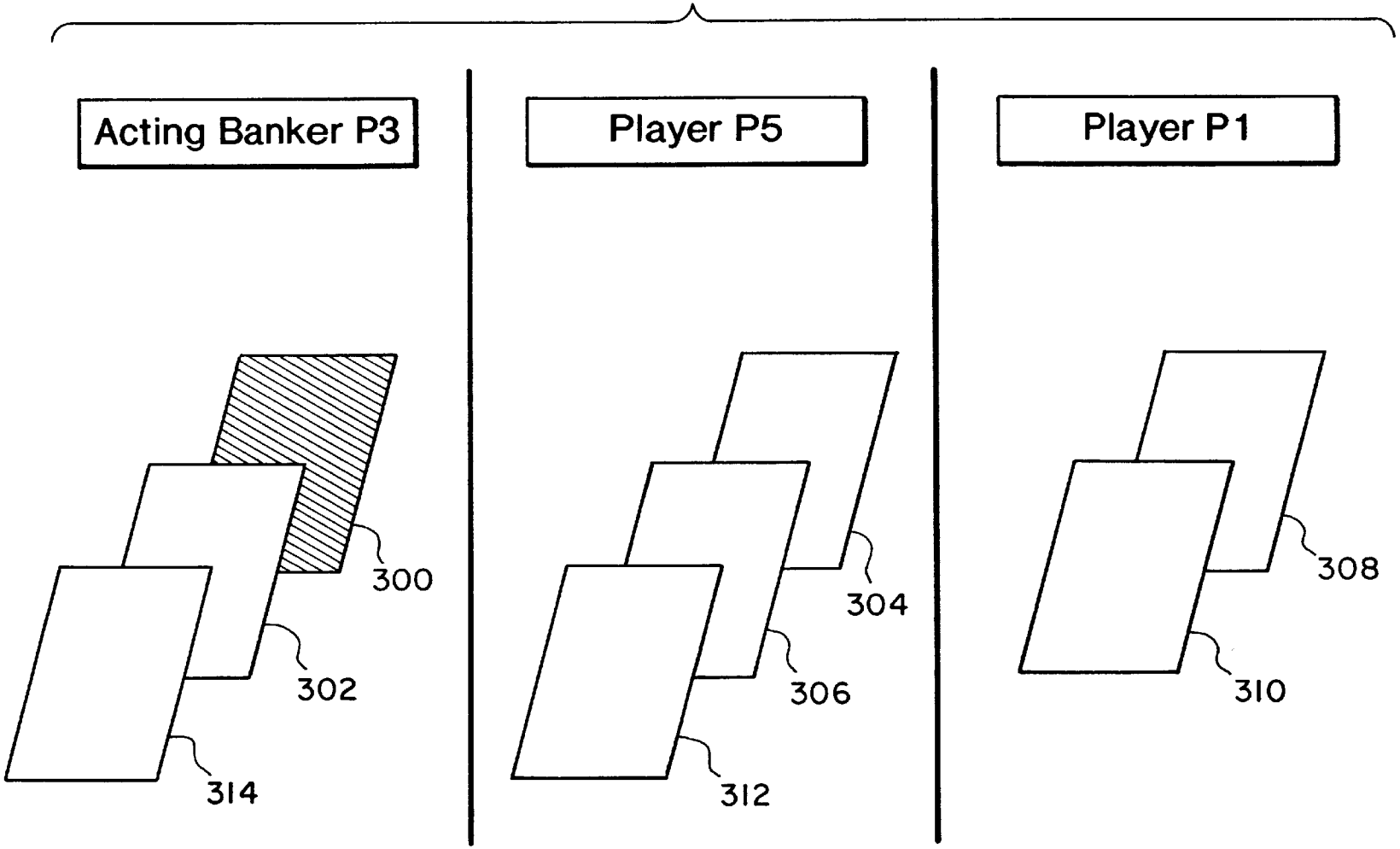
FIG. 4 illustrates the play between the acting banker and one of the players of FIG. 3.

FIG. 4 illustrates the positioning of cards following the completion of play of player P5's hand in which player P5 received card 312 and acting banker P3 received card 314. The play is completed according to the standard rules of Baccarat or Chemin de Fer.

Figure 5:
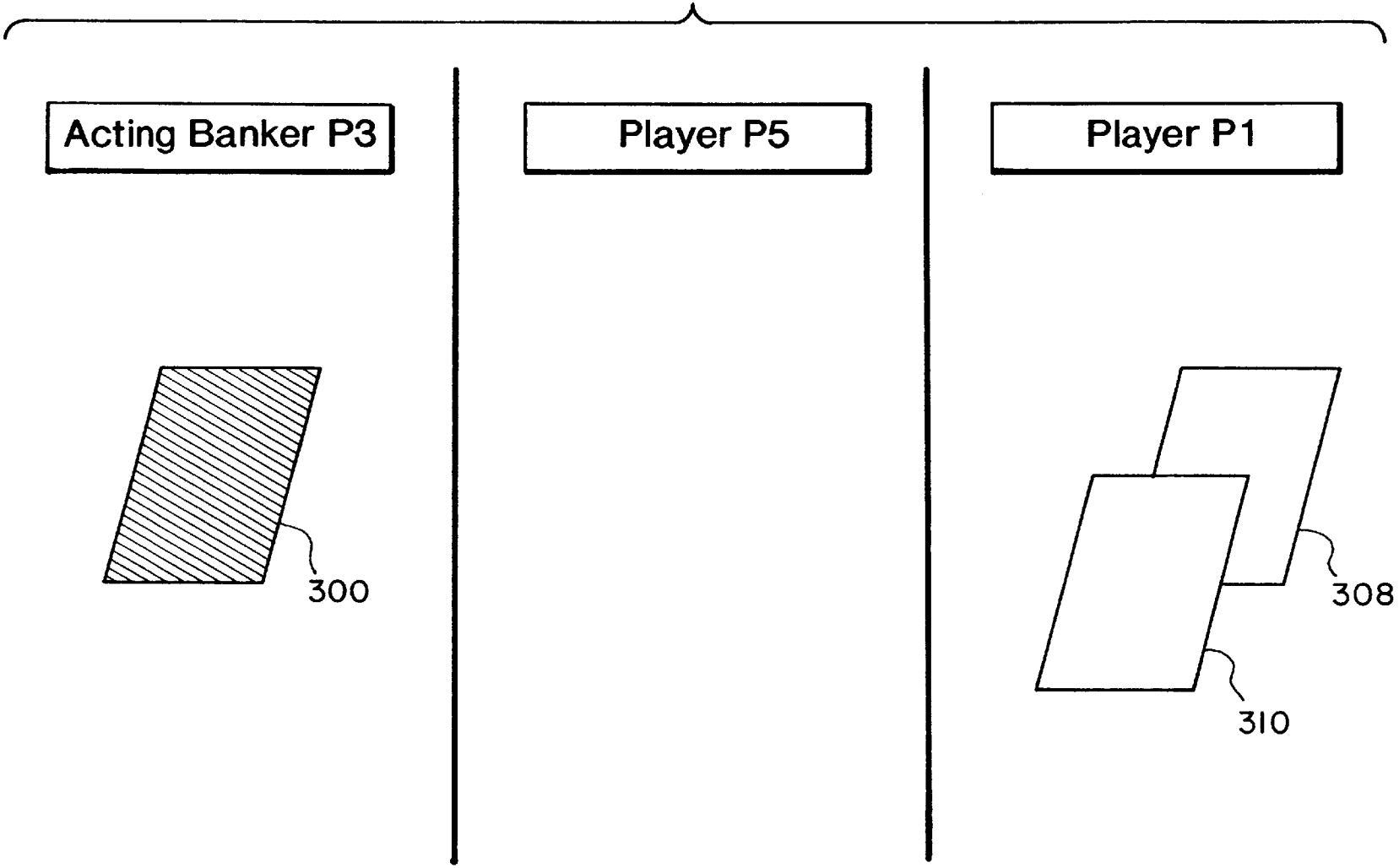
FIG. 5 illustrates the discarding of cards after the play of FIG. 4.

FIG. 5 illustrates the positioning of the cards after settlement of player P5's hand and subsequent discarding of the cards played. In the example, cards 302, 304, 306, 312, and 314 are discarded. Play now resumes with the next player P1. The acting banker retains the first face-up card 300. It is not discarded.

Figure 6:
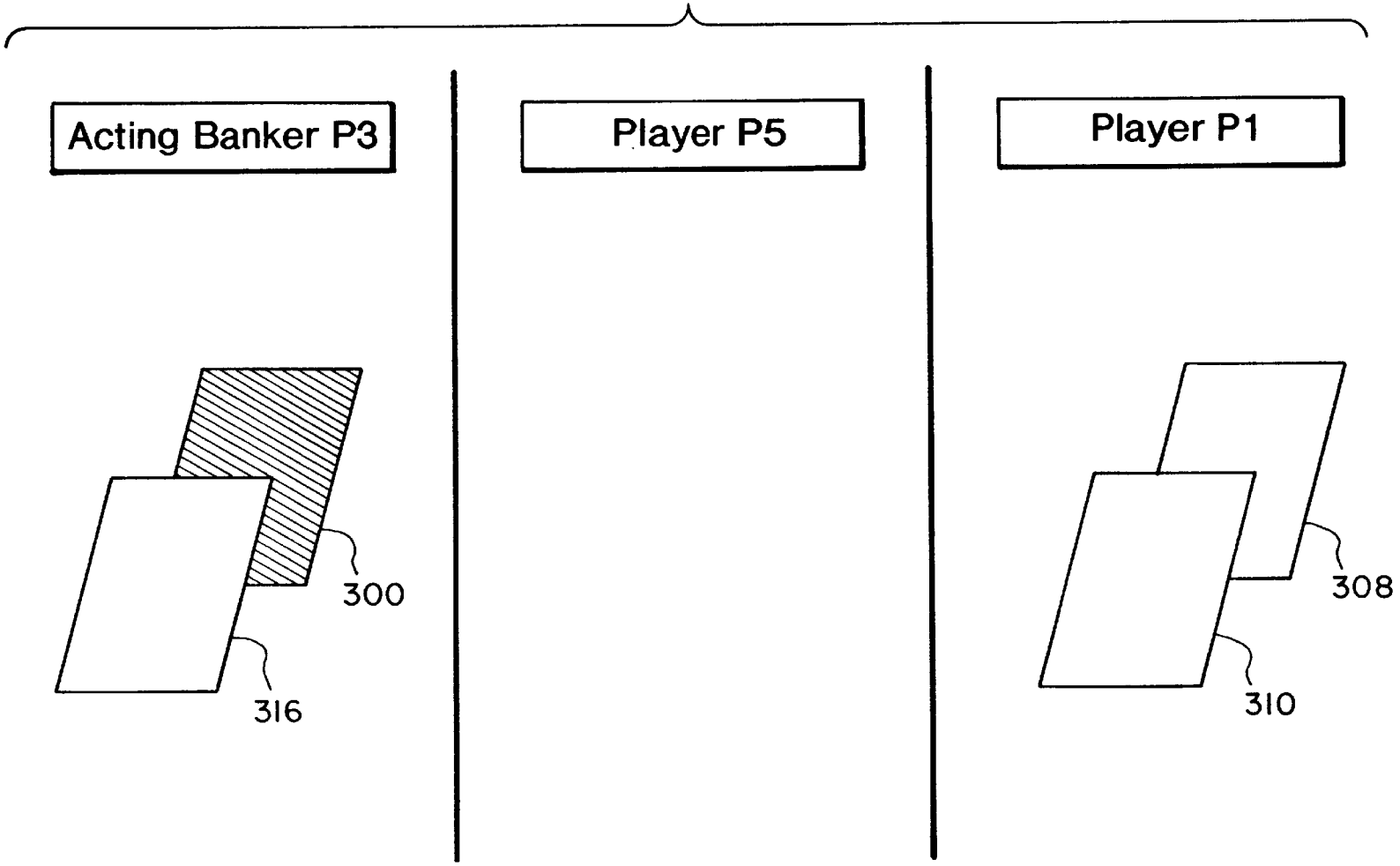
FIG. 6 illustrates the dealing of a fresh card to the acting banker so as to commence play between the acting banker and the next player.

FIG. 6 illustrates the positioning of cards once a new card 316 has been added to the acting banker's first card 300 and before the play of the next hand. The acting banker P3 receives a fresh card 316 from the dealer D and play now commences in conventional fashion between the acting banker P3 and the player P1.

Thus, the active banker's first face-up card is maintained with each player's hand, but the initial total of the banker's hand will vary according to the value of the second card as dealt in the above sequence.

The completion of play between the acting banker's hand and each remaining player's hand occurs according to the rules of the form of Baccarat followed, which may be Baccarat or Chemin de Fer (or another form). In the preferred embodiment the conventional card drawing rules of Baccarat are followed. The player's card drawing rules are set forth in Table II below.

TABLE II

| In the event the player or the banker has a natural 8 or 9, no further cards are drawn, otherwise the player acts first according to the instructions described below. | |
|---|---|
| PLAYER TOTAL | |
| 0, 1, 2, 3, 4, 5 | Draws |
| 6, 7 | Stands |
| 8, 9 | Natural. No further cards drawn |

the acting banker's card drawings rules are set forth in Table III below

TABLE III

| BANK TOTAL | DRAWS GIVING | STANDS GIVING . . . |
|---|---|---|
| 0, 1, 2 | always (unless player has natural) | |
| 3 | 1, 2, 3, 4, 5, 6, 7, 9, 10, no card | 8 |
| 4 | 2, 3, 4, 5, 6, 7, no card | 1, 8, 9, 10 |
| 5 | 4, 5, 6, 7, no card | 1, 2, 3, 8, 9, 10 |
| 6 | 6, 7 | 1, 2, 3, 4, 5, 8, 9, 10, no card |
| 7 | Stands | |
| 8, 9 | Natural | |

these card drawing rules are conventional for Baccarat and offer no discretion as they are all mandatory. This speeds up the play of the hand since a player or acting banker does not need to take time to decide discretionary draws.

As is conventional in Baccarat, the value of a hand is determined to be the last digit of the sum of a hand. For example, if player in position eight receives the following values: 10+5+8= 23, the value of his hand is determined to be the last digit (i.e., 3) of the sum of the hand. Hands that have a value higher than the value of the banker's hand win; hands that have a lower value than the banker's lose. Hands that have the same value as the banker's tie and are deemed to be a standoff or "push."

Method of Payment.

Prior to the deal all players and the acting banker will place their wagers. Each player's wager will win or lose in accordance with the ranking of hands against the banker's hand. At no time will the players win or lose more than the amount of their initial wager or the remainder of the acting banker's wager (also termed "the bank"). A player's potential loss will not exceed his potential win or vice-versa at any time. Thus all bets in a single player position are treated as one for the purpose of payment or collection. The acting banker's bank is cumulative throughout the course of one complete deal. That is to say, any winnings by the banker from any hand accrue to the value of the bank for consideration of subsequent hands.

EXAMPLE II

For example, FIG. 7*a* illustrates the initial wagers of an acting banker P3 (i.e., the initial "bank") and two players P1 and P5. The banker P3 banks two tokens. Player P5 bets four tokens and Player P1 bets four tokens. In this example, the most the banker can win is the value of his bank of two tokens from the player P5 (even though player P5 bet four tokens). FIG. 7*b* illustrates the status following a winning hand by the acting banker against player P5. Acting banker P3 now receives two tokens from player P5 and the new bank increases to four tokens. FIG. 7*c* illustrates the status following a subsequent winning banker hand played against player P1. The bank increases to eight tokens. FIGS. 7*a*, 7*b*, and 7*c* show the bank of the acting banker increasing during the play of the game from player to player. Setoffs of winnings by the acting banker are not permitted.

FIG. 8*a* shows the same initial scenario as in FIG. 7*a*, above. FIG. 8*b* shows the status following a losing banker hand played against player P5. In this event no hand would be played against player P1 since no equitable financial exchange is possible. The round of hands is over as the bank is exhausted. Furthermore, player P1 would not know the outcome of his hand against the banker since a fresh card would not be dealt to the acting banker. All remaining cards on the gaming table are discarded. The game ends with player P5 winning two tokens. Any players excluded from play will have their commission returned.

FIG. 9*a* again shows the initial same scenario as in FIG. 7*a*. FIG. 9*b* shows the status following a winning banker hand played against player P5. FIG. 9*c* shows the status following a subsequent losing hand played against player P1. The bank is exhausted and play stops.

Figure 7:
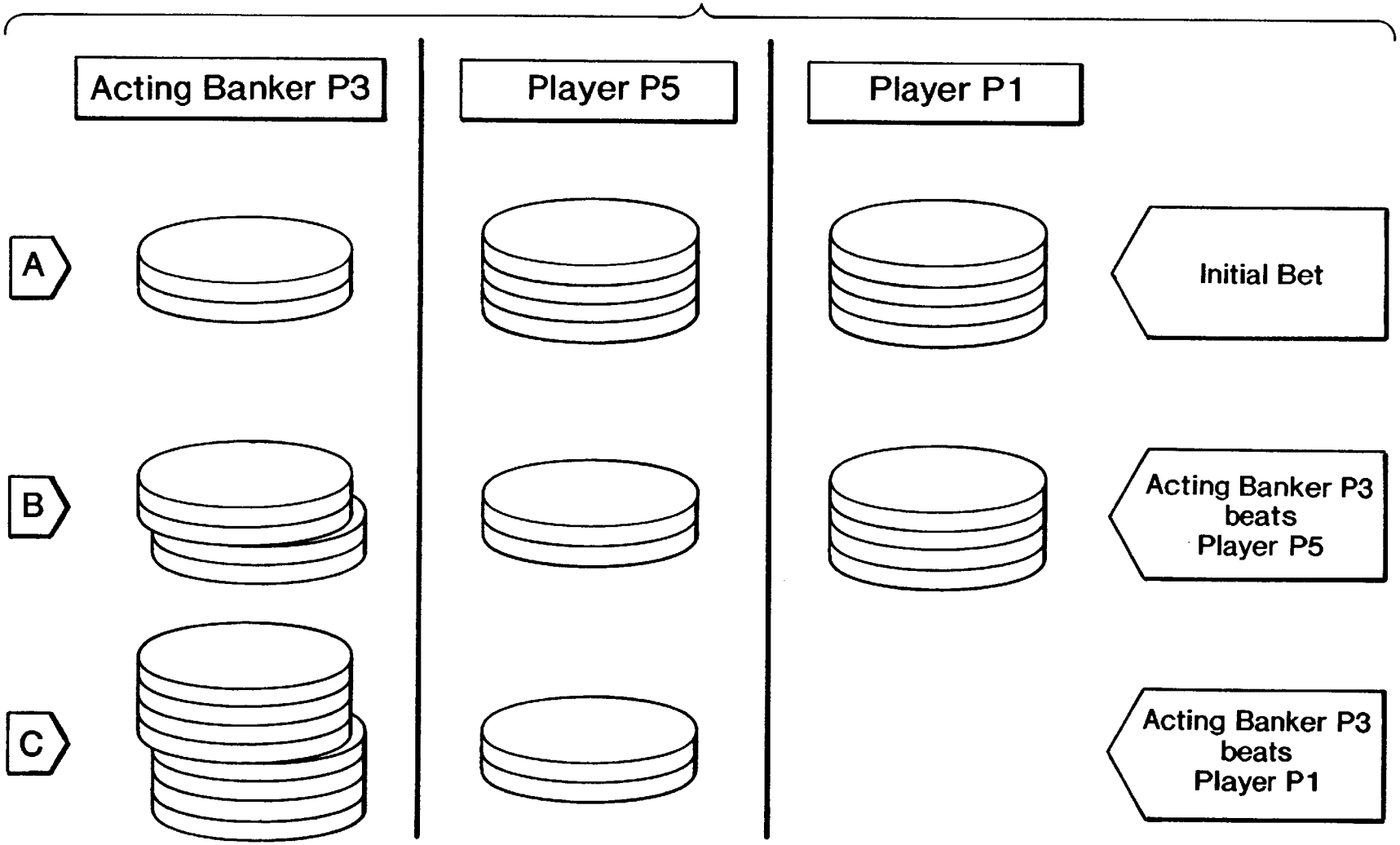
FIG. 7 illustrates the accumulation of value in the bank of the acting banker through winnings.
Figure 8:
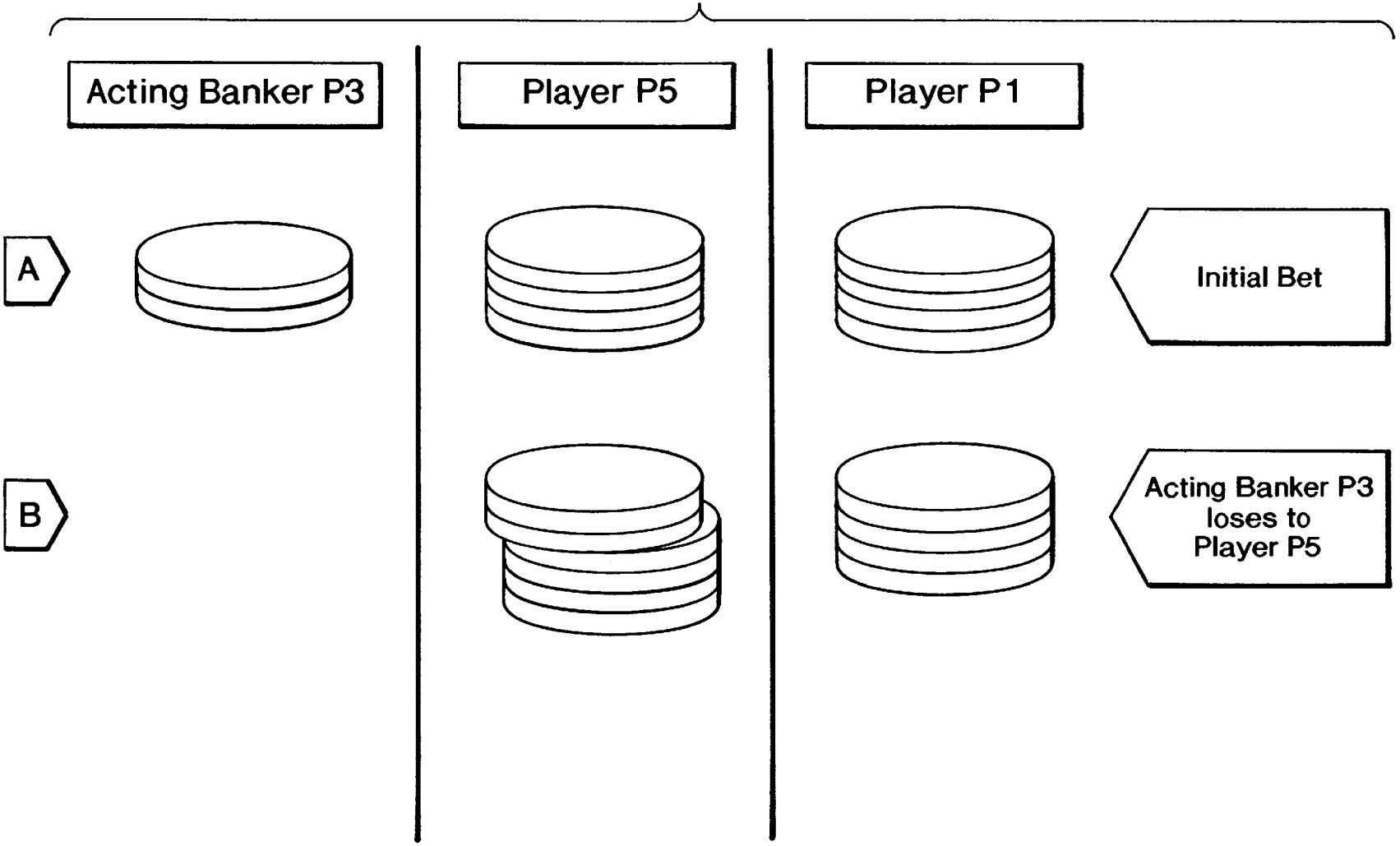
FIG. 8 illustrates the exhaustion of the initial bank through a loss.
Figure 9:
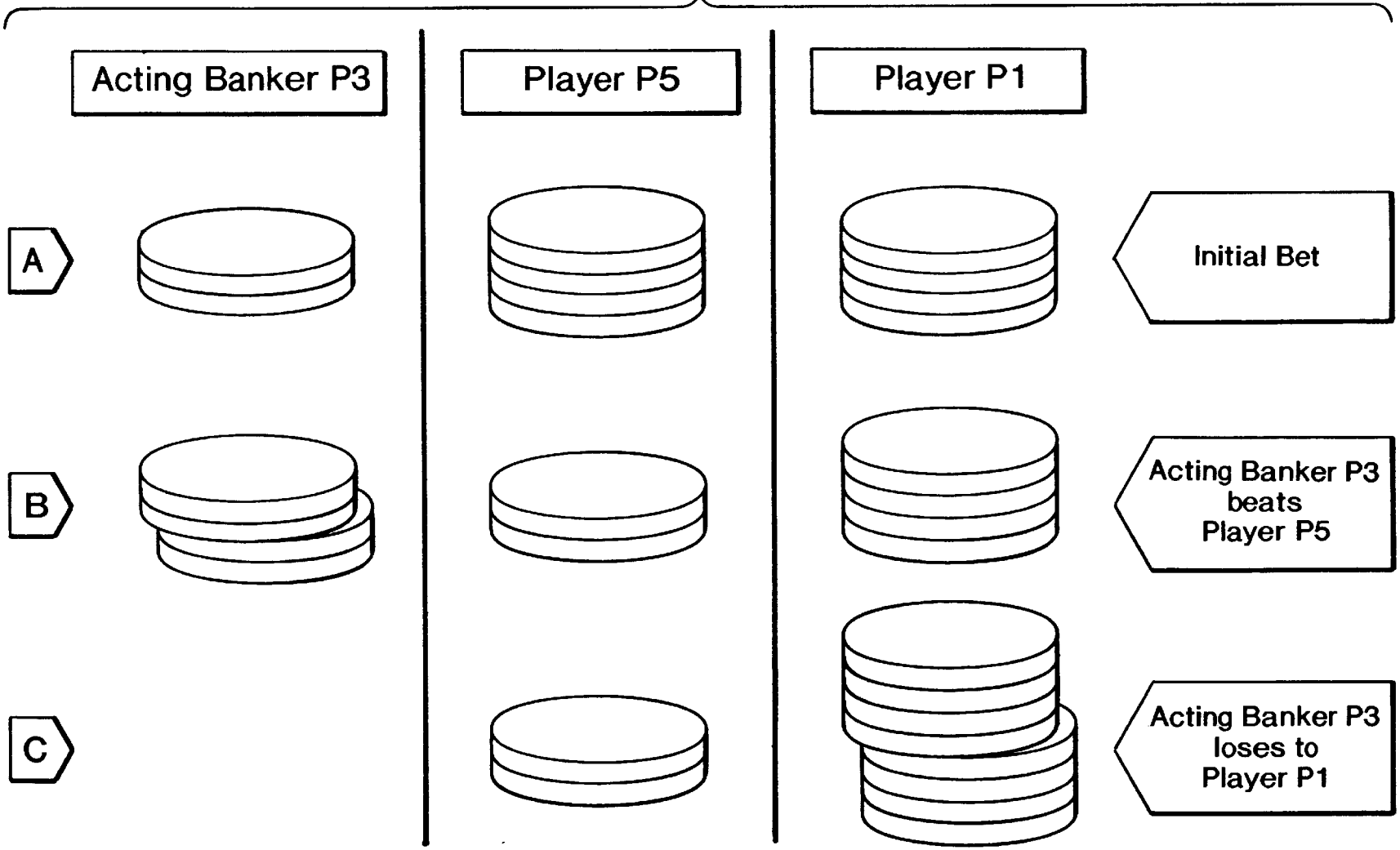
FIG. 9 illustrates the initial accumulation of winnings to increase the value of the bank and then the subsequent exhaustion of the bank through a loss.

It is clear that the bank may accumulate during the round thereby increasing participation by players (and side betters) at the table. While the examples shown in FIGS. 7 through 9 are presented only with respect to wagers made by players, it is to be expressly understood that any side bets by other players or other persons OP would also be transacted (i.e., adding to or subtracting from) with the bank in similar fashion.

Alternate Embodiments.

While the above represents the preferred embodiment based upon standard drawing rules of Baccarat, Baccara or Chemin de Fer, it is to be expressly understood that the teachings of the present invention extend to other embodiments.

In a first alternate embodiment, the dealer would deal one card only to each player, then the dealer would deal a second card only to the active player and to the banker. The dealer would then deal third cards to complete the play of the game. At the end of the play between the active player and the banker, the cards would be discarded with the exception of the banker's first card, and the next player would be dealt a second card followed by the banker's replacement second card, and then the play resumes between these two players.

In a second alternate embodiment, the following variant could be utilized with respect to the preferred embodiment as discussed above in Tables II and III or with the first alternate embodiment. In this variant, at the end of play between the banker and the active player, both or all three of the bank's cards, along with the player's cards, would be discarded. Then, to restart the game between the next player and the banker, in the case of the preferred embodiment, the bank would be dealt two cards consecutively and play would resume between the active player and the banker, or in the case of the first alternate embodiment, one card would be dealt to the banker and the second card to the active player, then a second card to the banker and play would resume between the active player and the banker.

Further, either of these alternate embodiments and the original embodiment may allow the players to make optional decisions traditionally allowed in the game of Baccarat European-style, or indeed to make other optional draws, that can be inserted into any of the games described in the present invention without changing the two main features. The two main features of the present invention permit playing a hand against each player and accumulating the winnings from each individual player hand to the bank.

The invention has been described with reference to the preferred embodiment. Modifications and alterations will occur to others upon a reading and understanding of this specification. This specification is intended to include all such modifications and alterations insofar as they come within the scope of the appended claims or the equivalents thereof.

We claim:

1. A method of playing a modified form of Baccarat played on a gaming table with at least one deck of 52 cards, a plurality of players seated at the gaming table, and a dealer positioned at the gaming table, said method comprising the steps of:

(a) selecting an acting banker from said plurality of players, (b) selecting an action player from said plurality of players, (c) the acting banker placing a bank on the gaming table, and each of the remaining plurality of players including the action player placing a wager on the gaming table, (d) the dealer commencing the deal of the cards with the action player, (e) the dealer dealing each player including the action player and the acting banker at least one card face up, (f) commencing play between the action player and the acting banker, (g) playing Baccarat between the acting banker and the player until completion, (h) if the acting banker wins, accumulating the losing player's wager to the bank, (i) if the player wins delivering amount equal to the player's wager from the bank, (j) discarding the player's cards and all of the acting banker's cards, (k) repeating steps (g) through (i) until the acting banker's bank is exhausted or until each player at the gaming table has played their dealt hands against the hand of the acting banker.

2. The method of playing Baccarat according to claim 1 wherein the step of selecting the acting banker is determined by a predetermined seating position at the gaming table.

3. The method of playing Baccarat according to claim 1 wherein the step of selecting the acting banker is based upon a randomization device.

4. The method of playing Baccarat according to claim 1 wherein the step of selecting the action player is based on a randomization process.

5. The method of playing Baccarat according to claim 1 wherein the cards are dealt by the dealer, commencing at the action button, and continuing in a predetermined order to the remaining players and acting banker around the table one card at a time.

6. The method of playing Baccarat according to claim 1 wherein two cards are dealt by the dealer, commencing at the action button, and continuing in a predetermined order to the remaining players and acting banker around the table two cards at a time.

7. The method of playing Baccarat according to claim 1 wherein the form of Baccarat is baccara.

8. The method of playing Baccarat according to claim 1 wherein the form of Baccarat is Chemin de Fer.

* * * * *